US005735550A

United States Patent [19]

Hinkle

[11] Patent Number: 5,735,550

[45] Date of Patent: Apr. 7, 1998

[54] SECURE CREDIT CARD

[76] Inventor: Michael B. Hinkle, 5911 E. University Blvd. Suite 108, Dallas, Tex. 75206

[21] Appl. No.: 658,956

[22] Filed: May 31, 1996

[51] Int. Cl.[6] ..... B42D 15/10

[52] U.S. Cl. ..... 283/108; 283/101; 283/904; 283/72; 283/81

[58] Field of Search ..... 283/81, 100, 101, 283/107, 108, 109, 110, 904, 72, 94, 901, 903, 74; 902/3, 4, 5, 27, 28; 273/139

[56] References Cited

U.S. PATENT DOCUMENTS

| | | | |
|---|---|---|---|
| 3,894,756 | 7/1975 | Ward | 350/3.61 X |
| 3,950,013 | 4/1976 | Tagliaferri | 283/58 X |
| 3,961,956 | 6/1976 | Fukuda et al. | 350/167 |
| 4,032,679 | 6/1977 | Aoyagi | 428/43 X |
| 4,066,873 | 1/1978 | Schatz | 283/85 X |
| 4,239,261 | 12/1980 | Richardson | 283/85 X |
| 5,299,834 | 4/1994 | Kraige | 283/79 X |
| 5,300,764 | 4/1994 | Hoshino et al. | 283/86 X |
| 5,308,120 | 5/1994 | Thompson | 283/70 |
| 5,531,482 | 7/1996 | Blank | 283/67 |

*Primary Examiner*—Frances Han
*Attorney, Agent, or Firm*—W. Thomas Timmons; Timmons & Kelly

[57] ABSTRACT

A secure transaction card (C) accepted for transactions by a customer has usable customer identifying information (I). The card (C) has a card body (16) with an upper surface (18). The upper surface (18) has an indicator area (20) indicating that the secure transaction card (C) should not be accepted for a transaction by the customer. A layer (22) removable from the card body (16) is adapted to be superimposed over the indicator area (20) such that the secured transaction card (C) is in an acceptable state (24) when the removable layer (22) covers the indicator area (20) and in an unacceptable state (26) when the removable layer (22) is absent or damaged.

9 Claims, 1 Drawing Sheet

SECURE CREDIT CARD

SPECIFICATION

Background of the Invention

1. Technical Field

The invention relates to the field of transaction cards and more particularly to increasing the security of such cards by preventing fraudulent uses.

2. Background Art

Transaction cards have been well known in the art. Such transaction cards have been used for credit and debit transactions, library services, and many other types of transactions. Typically, the transaction or credit cards are formed from flat, rectangular pieces of plastic and have customer identifying information embossed, imprinted or otherwise forming a part of the face or upper surface of the card. Often the back of a credit card contains a signature panel for the authorized card-holder and a magnetic strip with identifying information magnetically encoded.

Security of transaction cards, particularly credit and debit cards, has recently become a widespread problem and of increasing concern. In the past some credit cards have had a card security number hidden within the plastic forming the card body as one means to assist in preventing card fraud. Similarly, some credit card companies have included photo-identification of the card-holder imprinted on the face or embedded within the card. This photo-identification requires extra processing steps for the credit card issuer, and thereby increases the card issuer's costs.

A new and relatively simple means to prompt the person processing the card transaction to request a photo-identification of the card-bearer to ascertain that the card-bearer is the authorized user helps to prevent card fraud and to reduce the costs associated with the issuance of a card.

While the above cited references introduce and disclose a number of noteworthy advances and technological improvements within the art, none completely fulfills the specific objectives achieved by this invention.

Disclosure of Invention

In accordance with the present invention, a secure transaction card of the type that is accepted for transactions by a customer or card-bearer includes usable customer identifying information. The card has a card body with an upper surface. The upper surface has an indicator area that when it is visible to the clerk indicates that the secure transaction card should not be accepted for a transaction on behalf of the customer. A layer that is removable from the card body is adapted to be superimposed over the indicator area. The removable layer includes instructions or other authorizing information and blocks the indicator area from view. The secured transaction card is in an acceptable state when the removable layer covers the indicator area and in an unacceptable state for transactions when the removable layer is absent or damaged and exposed the indicator area.

Preferably, the removable layer has instructions to the store clerk or other person processing the transaction to ask the customer or card-bearer for a photo-identification. This would increase the likelihood that the authorized user of the card and the card-bearer are one and the same individual. If a thief stole the credit card and removed the removable layer to prevent the person processing the transaction with the card, the indicator area would be visible. This indicator area would alert the card processor or clerk to decline honoring the card, since the tampering of the card would be evident.

These and other objects, advantages and features of this invention will be apparent from the following description taken with reference to the accompanying drawings, wherein is shown the preferred embodiments of the invention.

BRIEF DESCRIPTION OF DRAWINGS

A more particular description of the invention briefly summarized above is available from the exemplary embodiments illustrated in the drawing and discussed in further detail below. Through this reference, it can be seen how the above cited features, as well as others that will become apparent, are obtained and can be understood in detail. The drawings nevertheless illustrate only typical, preferred embodiments of the invention and are not to be considered limiting of its scope as the invention may admit to other equally effective embodiments.

MODE(S) FOR CARRYING OUT THE INVENTION

Figure 1:
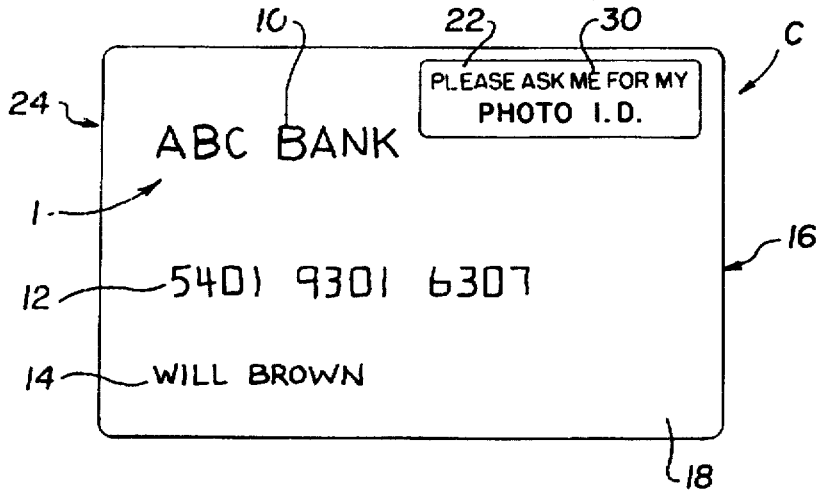
FIG. 1 is a top view of a secure transaction card of the present invention having a removable layer superimposed over the indicator area showing an acceptable state of the card.
Figure 2:
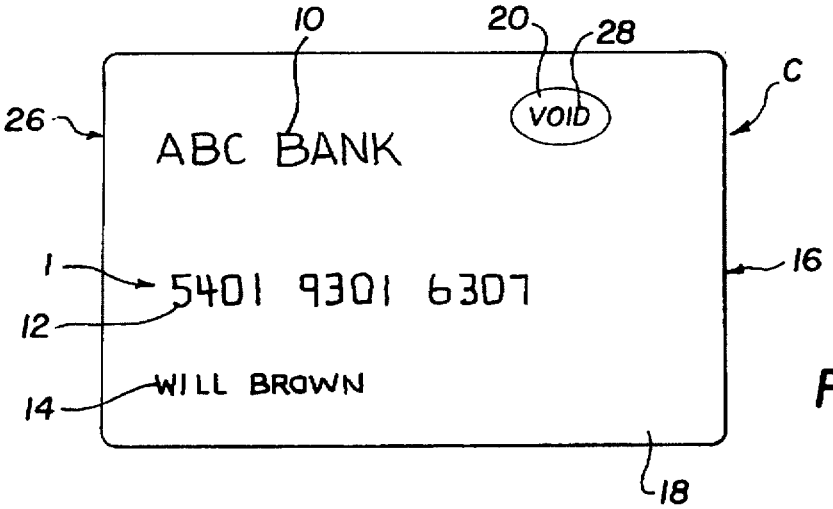
FIG. 2 is a top view of the secure transaction card of FIG. 1 with the removable layer removed showing the indicator area converting the card into an unacceptable state.

So that the manner in which the above recited features, advantages and objects of the present invention are attained can be understood in detail, more particular description of the invention, briefly summed above, may be had by reference to the embodiment thereof that is illustrated in the appended drawings. In all the drawings, identical numbers represent the same elements.

A secure transaction card C of the type that is accepted for transactions by a customer has usable customer identifying information I, such as the name of the banking or other issuing institution 10, an account number 12, and the authorized customers name 14. The card C has a card body 16 with an upper surface 18. The upper surface 18 has an indicator area 20 indicating that the secure transaction card C should not be accepted for a transaction by the customer, when the indicator area 20 is visible. A layer 22 removable from the card body 16 is adapted to be superimposed over the indicator area 20 such that the secured transaction card C is in an acceptable state 24 when the removable layer 22 covers the indicator area 20 and in an unacceptable state 26 when the removable layer 22 is absent or damaged.

The card body 16 of the present invention typically is the shape, size and composition of the known and frequently used types of credit or debit cards. Generally, such card body 16 is formed into a flat, rectangular plate and has certain identifying information printed or embossed on the face or upper surface 18.

The present secure transaction card C includes a indicator area 20 that informs the card processor, such as the sales clerk, that the card is void or is in an unacceptable state 24. The transaction processor should then dishonor the card or take other appropriate action for such a situation. Typically, the indicator area would include the word "VOID" 28 or some other term or design that has been permanently embossed or imprinted on the card in a tamper-resistant way that would deter a credit card thief from altering the card.

Figure 3:
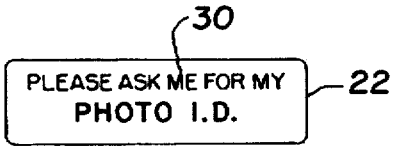
FIG. 3 is a top view of one embodiment of the removable layer.

A removable layer 22, such as a piece of thin plastic or metallic adhesive tape, is place over the indicator area 20 to convert the card C into an acceptable state 24 by hiding the indicator area 20 from view by the transaction processing clerk. Preferably, the removable layer would have instructions 30 to the transaction processor placed thereon. For example, the instructions could be the words, "PLEASE ASK ME FOR MY PHOTO I.D.," as shown in FIGS. 1 and 3. This instruction in view to the transaction processing clerk would help prevent card fraud by reminding or having the clerk ask the bearer of the card for a photo-identification to determine if the card-bearer were the authorized card-holder. Such correct or authorized instructions would preferably be known in advance by the transaction processor in order to detect a counterfeit removable layer 22 having been placed over the indicator area 20.

Alternatively, the removable layer 22 could include a hologram, a bank logo, or other known means to reduce the production of a counterfeit removable layer 22.

An additional benefit of the indicator area 20 having a raised or embossed VOID term 28 is that the VOID marking would appear on any credit card transaction slips that where embossed using the card when the removable layer 22 was damaged or absent when the card imprint was taken.

Figure 4:
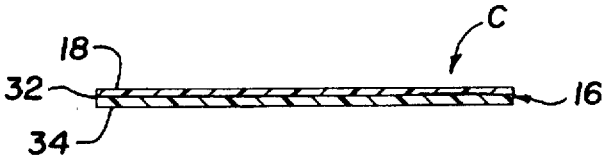
FIG. 4 is a cross section of an alternative embodiment of the secure transaction card with a frangible upper surface.

An alternative embodiment is shown in cross-section in FIG. 4 and includes a frangible or tamper-resistant upper layer 18 that is placed over an inner surface 32, which inner surface 32 is generally the top of a bottom layer 34, forming a sandwich with the upper layer 18 and bottom layer 34. The inner surface 32 is exposed when the frangible upper surface 18 is damaged. The inner surface 32 includes the indicator area 20 showing that the secure transaction card C should not be accepted for a transaction by the customer. In this alternative embodiment of the secured transaction card C, the card C is in an acceptable state when the frangible upper layer covers the indicator area 20 and the secured transaction card C is in an unacceptable state when the frangible upper layer 18 is absent or damaged.

The frangible upper layer 18 can be composed of a brittle, thin layer of plastic or an erasable type of paint or other tamper resistant layer. The frangible upper layer 18 would also include the instructions 30, logo or other validating information, such as a hologram.

In operation of the secured transaction card C, the authorized card-bearer would present the card C having the proper removable layer 22 superimposed on the embossed VOID 28 in the indicator area 20 of the upper surface 18 of the card body 16. The removable layer 22 would be authenticated by the transaction processor, such as a store clerk. In the embodiment in which the phrase "PLEASE ASK FOR MY PHOTO I.D." 30 is imprinted on the removable layer 22, then the clerk should request the photo-identification and verify that the card-bearer is the authorized card-holder. Otherwise, if the VOID marking 28 is visible, the clerk would refuse to honor the card and take the appropriate action for when the secure card C is in an unacceptable state 26.

The foregoing disclosure and description of the invention are illustrative and explanatory thereof, and various changes in the size, shape and materials, as well as in the details of the illustrated construction may be made without departing from the spirit of the invention.

I claim:

1. A secure transaction card of the type accepted for transactions by a customer and including usable customer identifying information, the secure transaction card comprising:

a card body;

said card body having an upper surface;

said upper surface including an indicator area indicating that the secure transaction card should not be accepted for a transaction by the customer; and, a layer removable tom said card body adapted to be superimposed over said indicator area;

whereby, the secured transaction card is in an acceptable state when the removable layer covers the indicator area and the secured transaction card is in an unacceptable state when the removable layer is absent or damaged.

2. The invention of claim 1 wherein said indicator area is resistant to unauthorized tampering.

3. The invention of claim 1 wherein said indicator area includes raised lettering imprinted into the card body.

4. The invention of claim 1 wherein said card body is essentially rigid.

5. The invention of claim 1 wherein said removable layer includes instructions to request photo-identification from the customer.

6. A secure transaction card of the type accepted for transactions by a customer and including usable customer identifying information, the secure transaction card comprising:

a card body;

said card body having a frangible upper surface and an inner surface beneath said upper surface, said inner surface being exposed when said frangible surface is damaged; and, said inner surface including an indicator area indicating that the secure transaction card should not be accepted for a transaction by the customer;

whereby, the secured transaction card is in an acceptable state when the frangible upper layer covers the indicator area and the secured transaction card is in an unacceptable state when the frangible upper layer is absent or damaged.

7. The invention of claim 6 wherein said indicator area is resistant to unauthorized tampering.

8. The invention of claim 6 wherein said card body is essentially rigid.

9. The invention of claim 6 wherein said removable layer includes instructions to request photo-identification from the customer.

* * * * *